US009474116B2

(12) United States Patent
Ng et al.

(10) Patent No.: US 9,474,116 B2
(45) Date of Patent: Oct. 18, 2016

(54) MINIMIZED COLOR SHIFT LIGHTING ARRANGEMENT DURING DIMMING

(71) Applicant: Avago Technologies General IP (Singapore) Pte. Ltd., Singapore (SG)

(72) Inventors: Keat Chuan Ng, Penang (MY); Choon Guan Ko, Penang (MY); Kheng Leng Tan, Penang (MY)

(73) Assignee: Avago Technologies General IP (Singapore) Pte. Ltd., Singapore (SG)

( * ) Notice: Subject to any disclaimer, the term of this patent is extended or adjusted under 35 U.S.C. 154(b) by 455 days.

(21) Appl. No.: 13/733,787

(22) Filed: Jan. 3, 2013

(65) Prior Publication Data

US 2014/0184096 A1 Jul. 3, 2014

(51) Int. Cl.
*H05B 37/02* (2006.01)
*H05B 33/08* (2006.01)

(52) U.S. Cl.
CPC ..... *H05B 33/0827* (2013.01); *H05B 37/02* (2013.01); *H05B 37/0272* (2013.01)

(58) Field of Classification Search
CPC ..... H05B 37/02
See application file for complete search history.

(56) References Cited

U.S. PATENT DOCUMENTS

| | | | | |
|---|---|---|---|---|
| 5,998,925 | A | 12/1999 | Shimizu et al. | |
| 6,636,003 | B2 | 10/2003 | Rahm et al. | |
| 7,288,902 | B1 * | 10/2007 | Melanson | 315/291 |
| 7,498,753 | B2 * | 3/2009 | McAvoy et al. | 315/291 |
| 7,564,180 | B2 | 7/2009 | Brandes | |
| 2008/0224635 | A1 * | 9/2008 | Hayes | 315/297 |
| 2010/0060171 | A1 | 3/2010 | Goitiandia et al. | |
| 2010/0259182 | A1 * | 10/2010 | Man et al. | 315/250 |
| 2011/0204778 | A1 * | 8/2011 | Sadwick et al. | 315/34 |
| 2013/0134901 | A1 * | 5/2013 | Park et al. | 315/294 |
| 2013/0141009 | A1 * | 6/2013 | Jin et al. | 315/292 |

FOREIGN PATENT DOCUMENTS

CN 101996587 A 3/2011

* cited by examiner

*Primary Examiner* — Douglas W Owens
*Assistant Examiner* — Pedro C Fernandez

(57) ABSTRACT

An illumination device, system, and method are disclosed. The illumination system includes a first set of light sources and a second set of light sources, driven by a first driver and second driver, respectively. The system further includes a dimming control system that implemented dimming control logic. The dimming control logic coordinates the operation of the first and second drivers such that the first and second sets of light sources are activated and deactivated so as to achieve substantially constant color temperature during dimming operations.

20 Claims, 7 Drawing Sheets

MINIMIZED COLOR SHIFT LIGHTING ARRANGEMENT DURING DIMMING

FIELD OF THE DISCLOSURE

The present disclosure is generally directed toward light emitting devices and particularly toward dimmable light emitting diodes.

BACKGROUND

Light Emitting Diodes (LEDs) have many advantages over conventional light sources, such as incandescent, halogen and fluorescent lamps. These advantages include longer operating life, lower power consumption, and smaller size. Consequently, conventional light sources are increasingly being replaced with LEDs in traditional lighting applications. As an example, LEDs are currently being used in flashlights, camera flashes, traffic signal lights, automotive taillights and display devices. LEDs have also gained favor in residential, industrial, and retail lighting applications.

Color temperature is a simplified way to characterize the spectral properties of a light source. While in reality the color of light is determined by how much each point on the spectral curve contributes to its output, the result can still be summarized on a linear scale. This value is useful, for example, for specifying the right light source types in architectural lighting design. Note, however, that light sources of the same color (metamers) can vary widely in the quality of light emitted. One may have a continuous spectrum, while the other just emits light in a few narrow bands of the spectrum. A useful way to determine the quality of a light source is its color rendering index. The Correlated Color Temperature (CCT) is a specification of the color appearance of the light emitted by a light source, relating its color to the color of light from a reference source when heated to a particular temperature, measured in degrees Kelvin (K).

Low color temperature implies warmer (more yellow/red) light while high color temperature implies a colder (more blue) light. Daylight has a rather low color temperature near dawn, and a higher one during the day.

Existing LED lighting exhibits color shift during dimming. Said another way, when the amount of current provided to an LED or group of LEDs is reduced from one current value to another current value, the brightness of the LED will change, but so too will the color produced by the LED. When the current provided to an LED is reduced from the maximum input current to the minimum allowable input current, the color of the LED could shift by as much as 300K CCT, which is generally noticeable by users. Because of this color-shifting phenomenon, it has been more difficult to provide a suitable LED alternative for dimmable lights.

SUMMARY

It is, therefore, one aspect of the present disclosure to provide a lighting arrangement that overcomes the above-noted shortcomings of LED-based lights. Specifically, embodiments of the present disclosure reduce LED color shifting at least by half as much as compared to the dimmable lighting arrangements of the prior art. This reduction in color shifting during dimming increases the desirability of LED alternatives in dimmable lights.

In accordance with at least some embodiments, an illumination device or system is provided that is capable of exhibiting a reduced fluctuation in CCT by employing at least two sets of different light sources during dimming. The second set of light sources, in some embodiments, will take over an active role for the first set after it is determined that the illumination device or system (e.g., all light sources) has been dimmed below a predetermined dimming threshold. In some embodiments, the illumination device or system may include a first driver configured to drive the first set of light sources and a second driver configured to drive the second set of light sources. Both the first and second driver may be connected to the same or different power supplies and may be connected to and controlled by a common dimming control system. The dimming control system may include control logic that is configured to control the drivers for each set of light sources, thereby coordinating the dimming process and maintaining a generally constant color temperature during dimming operations.

In some embodiments, a dimming method is provided that generally includes providing at least two sets of light sources with different CCTs into an illumination device or system. In some embodiments, the second set of light sources has a relatively higher CCT as compared to the first set of light sources when the light sources are driven at the same electrical current.

In some embodiments, the method continues when, at a maximum input current, the first set of light sources are activated (e.g., illuminated). As the current provided to the first set of light sources is reduced, the CCT of the first set of light sources also begins to reduce. At a predetermined point of dimming down (e.g., a transition condition), the dimming control system will detect the need to transition between the first set of light sources and the second set of light sources. Once a transition condition has been satisfied, the second set of light sources can be activated (e.g., illuminated) to help take over for or supplement the first set of light sources. As the second set of light sources is activated, the overall CCT of the illumination device or system will be pull up instead of continuing to drop.

It should be appreciated that the transition condition may comprise more than a single predetermined input current to the first set of light sources. Instead, the transition condition may correspond to a set of transition conditions or a dimming range, through which the second set of light sources is gradually allowed to take over for or supplement the first set of light sources. As dimming continues through the dimming range, the second set of light sources will begin to dominate the first set of light sources until the first set of light sources have been deactivated. Once the first set of light sources has been deactivated, the transition condition (or dimming range) may be considered completed and the remainder of dimming will be achieved via the second set of light sources only (e.g., the first set of light sources will already be deactivated).

In other embodiments, the first set of light sources may not totally switch off and be completely replaced by the second set of light sources. Rather, the first set of light sources may be dimmed down at a faster rate while the second set of light sources begin to lighten up at a predetermined rate. This soft transition will further help to reduce the color fluctuation due to color mixing.

In other embodiments, the first and second set of light sources may be activated at the same time, but the ratio of brightness for each set of light sources may vary. This varied brightness ratio may help to create a smooth CCT and brightness transition.

In yet other embodiments, the second set of light sources can have substantially the same or a slight lower CCT as compared to the first set of light sources, but the same desired dimming effects can be achieved when the number of light sources in the second set of light sources is less than the number of light sources in the first set of light sources (e.g., the first set of light sources has substantially more light sources than the second set of light sources). In such a configuration, when the second set of light sources take over for the first set of light sources, they may be initiated in a maximum current, but since the number of light sources in the second set of light sources is smaller than the number of light sources in the first set of light sources, the overall brightness is lower; this could enable a tolerable brightness continuity.

The present disclosure will be further understood from the drawings and the following detailed description. Although this description sets forth specific details, it is understood that certain embodiments of the invention may be practiced without these specific details. It is also understood that in some instances, well-known circuits, components and techniques have not been shown in detail in order to avoid obscuring the understanding of the invention.

BRIEF DESCRIPTION OF THE DRAWINGS

The present disclosure is described in conjunction with the appended figures.

DETAILED DESCRIPTION

The ensuing description provides embodiments only, and is not intended to limit the scope, applicability, or configuration of the claims. Rather, the ensuing description will provide those skilled in the art with an enabling description for implementing the described embodiments. It being understood that various changes may be made in the function and arrangement of elements without departing from the spirit and scope of the appended claims.

Figure 1:
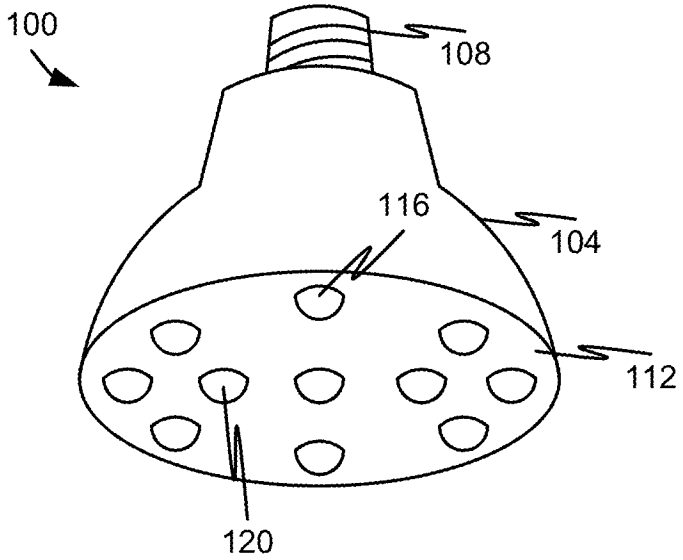
FIG. 1 is an isometric view of a dimmable illumination device in accordance with embodiments of the present disclosure.

With reference now to FIG. 1, an illustrative illumination device 100 is depicted in accordance with at least some embodiments of the present disclosure. The depicted illumination device 100 corresponds to an LED-based lamp, having a flood light configuration. It should be appreciated, however, that embodiments of the present disclosure are not limited to the specific configuration of illumination device 100 depicted. Rather, embodiments of the present disclosure may be applied to any type of illumination device or collection of illumination devices such as tube lighting, flood lighting, track lighting, chandeliers, fan lights, pendant lighting, recessed or can lighting, etc.

The depicted illumination device 100 comprises a body 104, an interconnect 108, a face 112, a first type of light source 116, and a second type of light source 120. The body 104 may comprise a heat sink component in addition to housing other parts of the illumination device 100. For instance, the body 104 may house the circuitry used to drive the light sources 116, 120 as wells as the components that condition the power supplied to the light sources 116, 120. More specifically, the body 104 may comprise one or more Printed Circuit Boards (PCBs) onto which the light sources 116, 120 can be mounted as well as the electrical components used to operate the light sources 116, 120. In addition, the body 104 may be constructed of a thermally-conductive material (e.g., aluminum or metal alloys) to help dissipate heat generated by the light sources 116, 120 during operation.

One end of the body 104 may be connected to an interconnect 108. The interconnect 108 may provide the illumination device 100 with the ability to mechanically and electrically join with a lighting fixture or outlet. In some embodiments, the interconnect 108 may comprise a male threaded metal portion that interfaces with male threaded female portion of a lighting fixture or outlet. Current provided to the illumination device 100 may initially pass from wiring in a wall, for example, to the lighting fixture or outlet where it is received at the interconnect 108. The interconnect 108 may be electrically connected to the drivers contained in the body 104 which ultimately condition and provide current to the light sources 116, 120.

The face 112 of the body 104 may correspond to a planar or non-planar surface where the light sources 116, 120 are exposed. In some embodiments, the face 112 may directly expose the light sources 116, 120. In some embodiments, the light sources 116, 120 may be mounted to the face and then shielded with a transparent or translucent cover. The cover, as an example, may comprise one or more light diffusing elements that help soften the light emitted by the light sources 116, 120 prior to exiting the illumination device 100. Other embodiments may simply comprise the light sources 116, 120 mounted in an exposed fashion on the face 112.

The illustrative illumination device 100 comprises a first type of light source 116 and a second type of light source 120 and multiple of each type of light source are depicted. It should be appreciated that embodiments of the present disclosure are not so limited. Instead, embodiments of the present disclosure contemplate an illumination device 100 that comprises a single first type of light source 116 and a single second type of light source 120 in a basic configuration. More elaborate configurations are also contemplated. As a non-limiting example, an illumination device 100 may have a first set of light sources of the first type and a second set of light sources of the second type. The number of light sources in the first set of light sources (e.g., the number of light sources 116) may be greater than, less than, or equal to the number of light sources in the second set of light sources (e.g., the number of light sources 120). As a more specific non-limiting example, the number of light sources in the second set of light sources may be substantially less (e.g., 1.25, 1.5, 2, 3, or more times less) than the number of light sources in the first set of light sources. Further still, although only two types of light sources 116, 120 are depicted, it should be appreciated that embodiments of the present disclosure contemplate an illumination device 100 and system that comprises two, three, four, five, six, seven, or more different types of light sources. Each of the different types of light sources may be separated into different sets of light sources where each type is driven by a different driver or some different types of light sources may be included in a common set of light sources such that they are driven by the same driver.

The light sources 116, 120 may be distributed across the face 112 in any configuration. As an example, the light sources 116, 120 may be randomly or evenly distributed across the face 112 to provide an even light output. Alternatively, some of the first type of light sources 116 may be clustered while some of the second type of light sources 120 may be clustered. As another example, the light sources 116, 120 may be organized in alternating concentric rings (e.g., inner ring of first type of light sources 116, second inner ring of second type of light sources 120, third inner ring of first type of light sources 116, etc.).

Any type of known light source may be used for the light sources 116, 120. As some non-limiting examples, the light source(s) 116, 120 may correspond to an LED, an array of LEDs, a laser diode, or the like. In some embodiments, a plurality of LEDs may be configured to emit light when a voltage difference is applied across the anode and cathode of the LEDs (e.g., current is provided to the LEDs). In some embodiments, the light source(s) 116, 120 may comprise a thru-hole mount LED and/or surface mount LED. Another type of light source 116, 120 that may be employed in accordance with embodiments of the present disclosure is an Organic LED (OLED) sheet or film.

In some embodiments, the first type of light source 116 may have at least one different characteristic or property as compared to the second type of light source 120. As a non-limiting example, the first type of light source 116 may be configured to emit light of a first predetermined wavelength or color whereas the second type of light source 120 may be configured to emit light of a second predetermined wavelength or color that is different from the first predetermined wavelength or color. As another non-limiting example, the first type of light source 116 may comprise a first type of encapsulant while the second type of light source 120 may comprise a second type of encapsulant. More specifically, the first type of light source 116 may be encapsulated in a first type of encapsulant (e.g., having a first type of phosphor, epoxy, silicone, combinations thereof, etc.) while the second type of light source 120 may be encapsulated in a second type of encapsulant (e.g., having a second type of phosphor, epoxy, silicone, combinations thereof, etc.). In yet another non-limiting example, the first light source 116 comprises a lower CCT as compared to the second light source 120 when both light sources are driven at substantially the same current. Other variations between the first type of light source 116 and second type of light source 120 are also contemplated.

Figure 2:
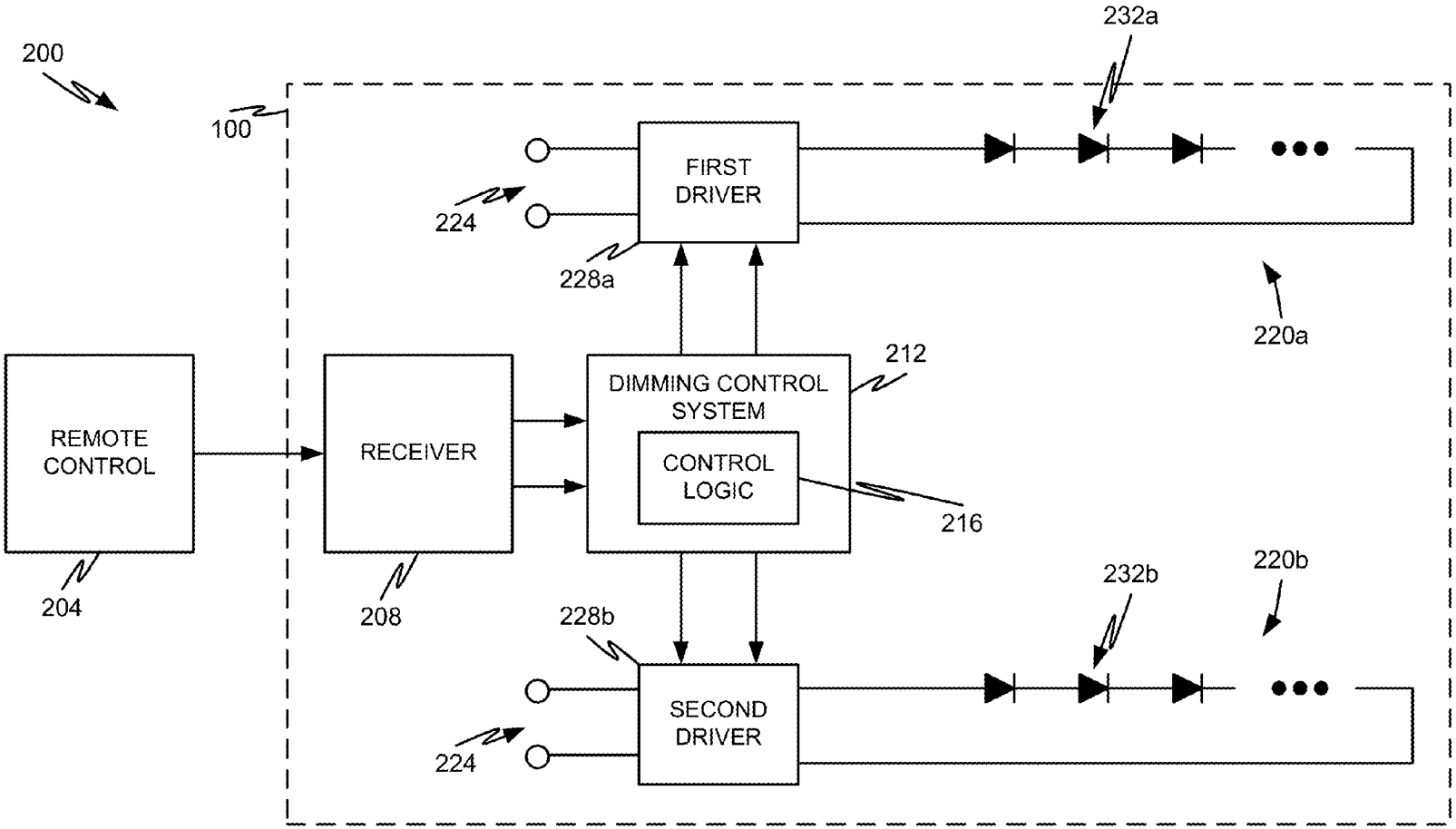
FIG. 2 is a block diagram of an illumination system in accordance with embodiments of the present disclosure.

With reference now to FIG. 2, an illustrative illumination system 200 will be described in accordance with at least some embodiments of the present disclosure. The illumination system 200 is depicted as incorporating a single illumination device 100; however, it should be appreciated that an illumination system 200 may comprise multiple illumination devices 100 without departing from the scope of the present disclosure.

The illumination system 200 may comprise a remote control 204 adapted to adjust and/or control the operation of the illumination device 100. Specifically, the remote control 204 may be operated by a user that wishes to adjust or control the brightness of the illumination device 100. In particular, the remote control 204 may enable a user to remotely turn on, turn off, dim, or brighten the illumination device 100. As used herein, the term "dimming" will be used to refer to both the act of decreasing the amount of current provided to the illumination device 100 as well as the act of increasing the amount of current provided to the illumination device 100. In other words, a user may be dimming the illumination device 100 by dictating the amount of current provided to the illumination device 100 to be less than the maximum allowable current, regardless of whether or not the provided current is being increased or decreased. The control exerted over the amount of current provided to the illumination device 100 may be facilitated by the remote control 204, which may be portable, handheld, or wall-mounted.

A wall-mounted remote control 204 will generally communicate with the receiver 208 via a wired connection. A portable or handheld remote control 204 will generally communication with the receiver 208 via a wireless connection. More specifically, the remote control 204 and receiver 208 may communicate via one or more of Radio Frequency (RF) communications, Infrared (IR) communications, Bluetooth, Ultrahigh Frequency (UHF) communications, WiFi (e.g., in accordance with one or more IEEE standards such as IEEE 802.11x), ZigBee, Near Field Communications (NFC), acoustically, etc.

In some embodiments, the remote control 204 communicates with the receiver 208 to provide instructions for controlling the light output by the illumination device 100. Specifically, the remote control 204 may provide a user with options to dim, brighten, turn on, and/or turn off the illumination device 100 or multiple illumination devices 100 (e.g., multiple illumination devices within a common room, building, area, etc.). The user input received at the remote control 204 is communicated to the receiver 208 as described above. The receiver 208 may translated the instructions received from the remote control 204 into instructions that can be understood and/or interpreted by a dimming control system 212.

In accordance with at least some embodiments, the illumination system 200 comprises a dimming control system 212 that can be used to control the dimming operations of one or more illumination devices 100. More specifically, the dimming control system 212 may comprise control logic 216 that converts the instructions received at the receiver 208 into light control operations. The light control operations may then be carried out with the dimming control system 212 instructing one or more drivers 228*a*, 228*b* to adjust the amount of current provided to their respective circuitry 220*a*, 220*b*.

In some embodiments, the control logic 216 may be provided as an Application Specific Integrated Circuit (ASIC), firmware, a Programmable Logic Controller (PLC), or combinations thereof. In some embodiments, the control logic 216 may be implemented as instructions stored in memory and executed by a microprocessor or set of microprocessors. In some embodiments, the control logic 216 may comprise the logic to determine whether one or both of the light sources 232*a*, 232*b* should be turned on, turned off, dimmed, or brightened. More specifically, the control logic 216 may be configured to determine if the user is providing an instruction to dim the illumination device 100 and, if so, further determine how much the illumination device 100 should be dimmed (e.g., what percentage of the maximum light output is desired). Based on the amount of dimming that is being requested by the user of the remote control 204, the control logic 216 may be capable of selectively controlling whether one or both circuits 220*a*, 220*b* should receive current from their respective drivers 228*a*, 228*b*.

In some embodiments, the first circuit 220*a* may comprise a first set of light sources 232*a*, which may include one or more of the first type of light sources 116. Similarly, the second circuit 220*b* may comprise a second set of light sources 232*b*, which may include one or more of the second type of light sources 120. As a non-limiting example, the first type of light sources 116 in the first set of light sources 232*a* may be connected in series to form the first circuit 220*a* while the second type of light sources 120 in the second set of light sources 232*b* may be connected in series to form the second circuit 220*b*.

The first circuit 220*a* may have its current controlled or driven by the first driver 228*a* whereas the second circuit 220*b* may have its current controlled or driven by the second driver 228*b*. The drivers 228*a*, 228*b* may each be connected to a power input 224, which may be a common power input or different power inputs. As an example, a single power input 224 (A/C or D/C) may be collected from the interconnect 108 and provided to both drivers 228*a*, 228*b*. Each driver 228*a*, 228*b* may then adjust the amount of current passed along to their respective circuit 220*a*, 220*b* based on the instructions received from the dimming control system 212. Although not depicted, the circuits 220*a*, 220*b* may comprise other circuit components such as one or more resistors, capacitors, inductors, diodes, transistors, or the like.

Furthermore, although certain components are depicted in FIG. 2 as being incorporated in the illumination device 100, it should be appreciated that one, some, or many components depicted as being incorporated within the illumination device 100 may actually be physically separated from the illumination device 100. For instance, a receiver 208 and/or dimming control system 212 may be integrated into the illumination device 100 (e.g., within the housing 104) as depicted. Alternatively, the receiver 208 and/or dimming control system 212 may be separate from the illumination device 100 and may be provided with a lighting fixture or as some other discrete component. Further still, a single dimming control system 212 and control logic 216 may be used to control the brightness of a plurality of illumination devices 100 by providing a common driver input to the drivers of each illumination device 100. In other words, the configuration of the system 200 depicted in FIG. 2 is for discussion purposes only and should not be construed as limiting the claims in any way.

With reference now to FIGS. 3-6, various strategies for dimming one or more illumination devices 100 will be described in accordance with at least some embodiments of the present disclosure. The various strategies may be implemented or enforced by an appropriately programmed or designed dimming control system 212 with control logic 216. The legend for FIGS. 3-6 is depicted above FIG. 3 for ease of reference. The first set of light sources 232*a* may correspond to "Set A" in FIGS. 3-6, while the second set of light sources 232*b* may correspond to "Set B." FIGS. 3-6 also show the resultant CCT output by the illumination device 100 or system 200 when implementing a dimming strategy.

Although each of the dimming strategies in FIGS. 3-6 will be described in connection with a decrease in current provided to the illumination device 100, it should be appreciated that the logic in most cases can simply be reversed for dimming conditions where current provided to the illumination device 100 is being increased, but is still less than the maximum current (e.g., less than full brightness is desired).

It should also be appreciated that the control logic 216 may be programmed to implemented, one, some, or all of the dimming strategies disclosed herein. In other words, it is not necessary to limit the functionality of the control logic 216 to a single dimming strategy. Rather, the control logic 216 can be configured to implement many different dimming strategies and a user may be allowed to select which among the multiple dimming strategies should be implemented by the control logic 216 (e.g., via a selector mechanism or the like).

Figure 3:
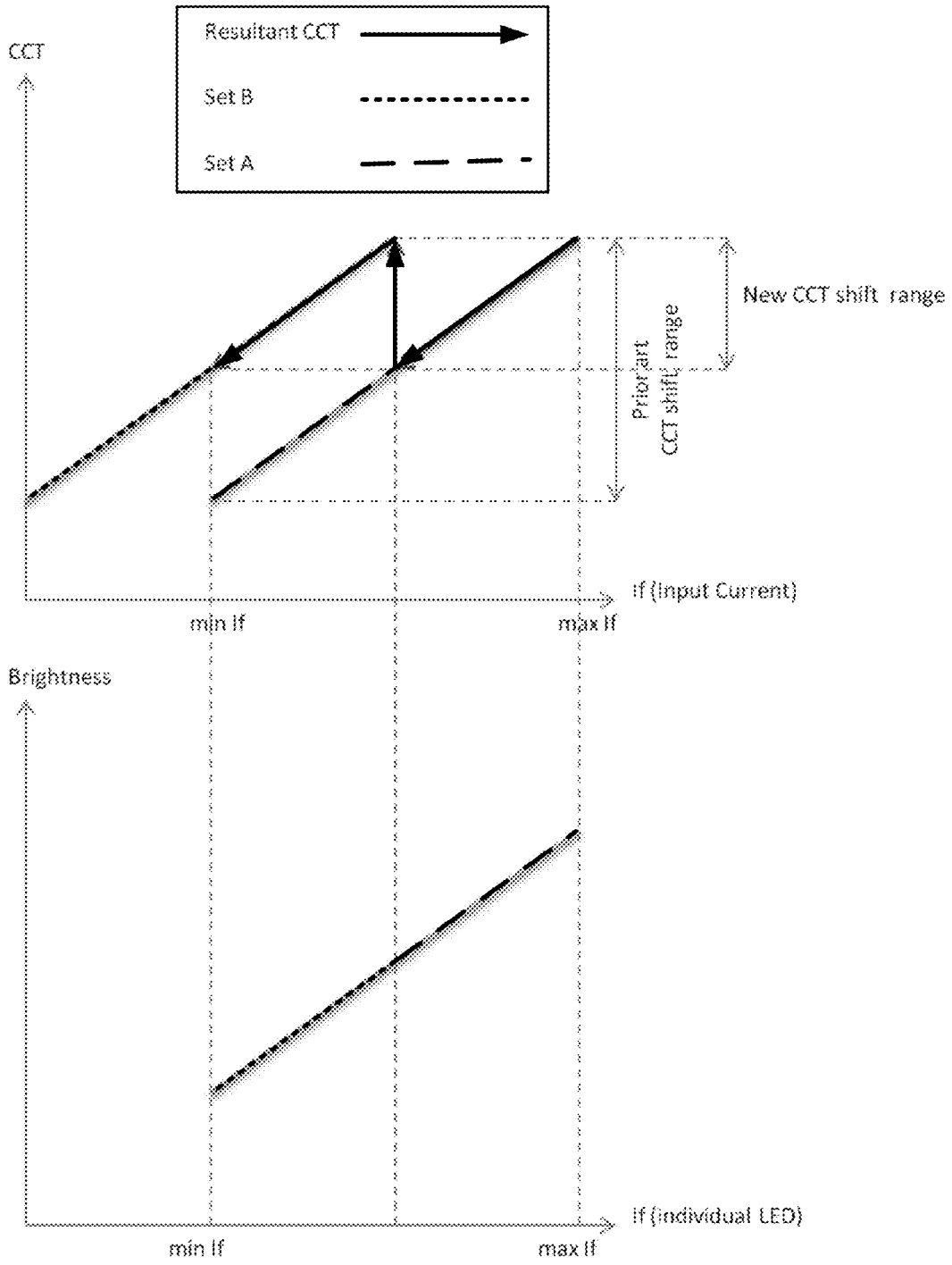
FIG. 3 is a set of charts depicting CCT and brightness as a function of input current for a first lighting arrangement in accordance with embodiments of the present disclosure.

A first dimming strategy is depicted in FIG. 3 whereby a single transition condition is enforced. This first dimming strategy represents possibly the simplest dimming strategy, but may not necessarily result in the best continuity of CCT throughout the entire dimming operation. In particular, a single dimming threshold or predetermined input current may be set or defined within the control logic 216 as a transition condition. At the predetermined dimming point (e.g., when input current is a predetermined percentage of maximum input current), the control logic 216 will detect the reduction in input current has crossed the transition condition and the first set of light sources 232*a* will be switched off in favor of the second set of light sources 232*b*. In implementation, when the control logic 216 detects that dimming has reached the transition condition, the control logic 216 may generate and send two instructions. A first of the instructions may be sent to the first driver 228*a* that causes the first driver 228*a* to discontinue providing current to the first circuit 220*a*. A second of the instructions may be sent to the second driver 228*b* that causes the second driver 228*b* to start providing current to the second circuit 220*b*. It may be desirable to stage the order in which the first and second instructions are sent—specifically it may be desirable from a continuity of lighting perspective to send the first instruction prior to sending the second instruction.

Additionally, a certain amount of hysteresis may be built into the control logic 216 to prevent unwanted switching back and forth if the dimming instructions cause the input current to be at or about the transition condition. Specifically, the control logic 216 may not switch back and forth between states unless a predetermined amount of time has passed since a switch occurred.

As can be appreciated, the transition condition (predetermined ratio of maximum input current) may be set to any value between, but not including 0% and 100% of maximum input current. As one non-limiting example, the control logic 216 may implement a switch between the sets of light sources when input current is at a value of approximately 50% of maximum input current. As another non-limiting example, the transition condition may be programmed to occur when input current is at a value of 30% of maximum input current. It may also be desirable to determine at which point of dimming the first type of light source 116 in the first set of light sources 232*a* begin to exhibit noticeable color shifting and the transition condition may be set to a value slightly above that point of dimming. Additionally or alternatively, the transition condition may be set based on the CCT of the first type of light source 116 and/or the second type of light source 120.

Figure 4:
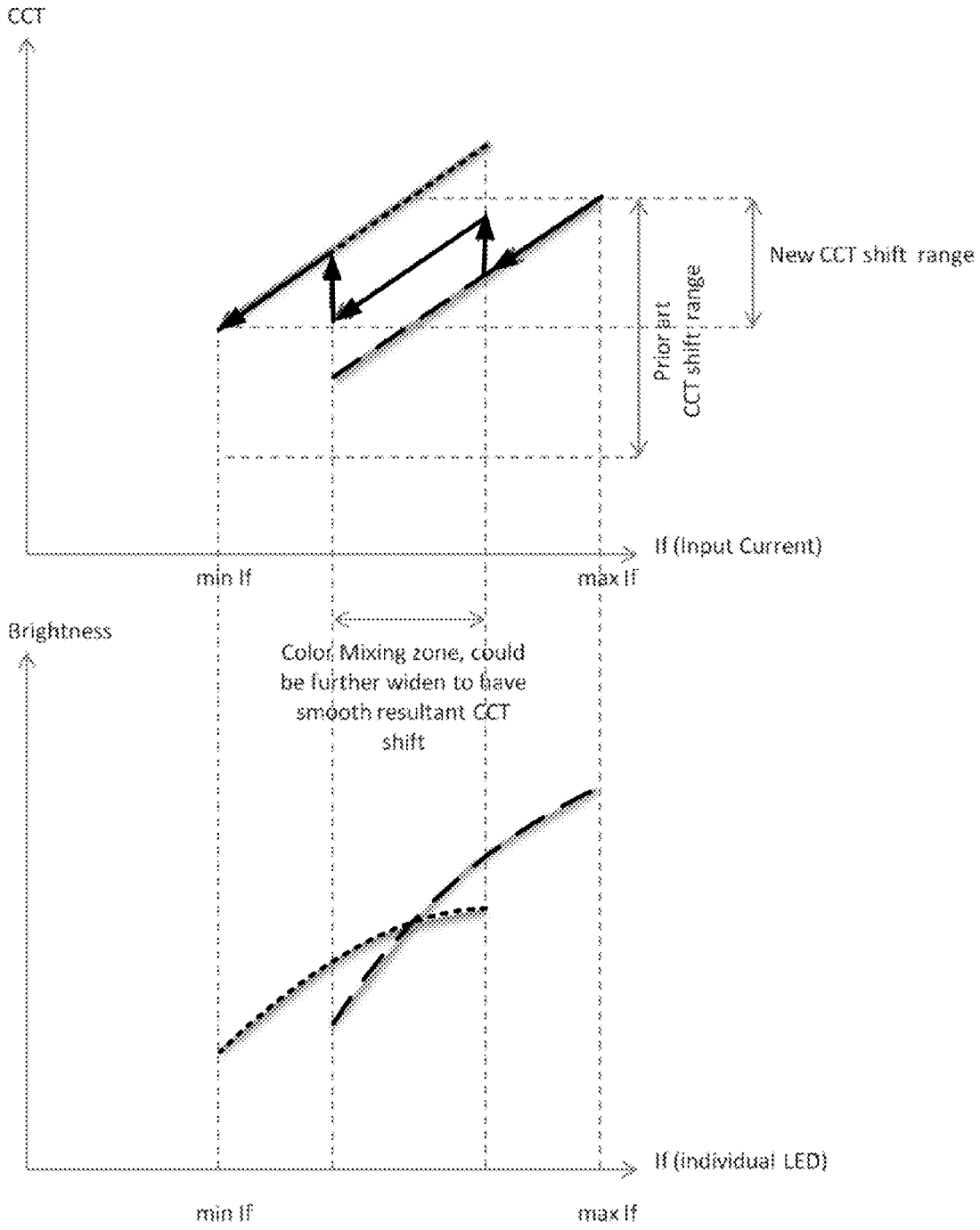
FIG. 4 is a set of charts depicting CCT and brightness as a function of input current for a second lighting arrangement in accordance with embodiments of the present disclosure.

FIG. 4 depicts another dimming strategy in accordance with at least some embodiments of the present disclosure. The dimming strategy depicted in FIG. 4 implements logic where the first set of light sources 232*a* are not totally switched off at a transition condition, but rather are gradually dimmed in favor of the second set of light sources 232*b* being gradually brightened, or vice versa. In particular, a mixing zone may be enforced to further smooth the resultant CCT shift of the illumination device 100 or illumination system 200.

The mixing zone may itself correspond to an extended transition condition and the mixing zone may comprise an upper bound and a lower bound. The upper bound may correspond to a first point where the extended transition condition starts and the first set of light sources 232*a* begins to dim and/or the second set of light sources 232*b* begins to brighten. In some embodiments, the upper bound of the extended transition condition may at least correspond to a point where the second set of light sources 232*b* is turned on, perhaps at less than maximum input current for the second circuit 220*b*. The lower bound may correspond to a second point where the extended transition condition ends and the first set of light sources 232*a* are turned off and/or the second set of light sources 232*b* are operating at full current input.

It should be appreciated that the first set of light sources 232*a* does not necessarily have to be dimmed at the same rate as which the second set of light sources 232*b* are brightened. Specifically, the first set of light sources 232*a* may be dimmed faster than the rate at which the second set of light sources 232*b* are brightened or the first set of light sources 232*a* may be dimmed slower than the rate at which the second set of light sources 232*b* are brightened. As can be seen in FIG. 4, the implementation of a mixing zone or extended transition condition may result in a smaller color shifting range while still providing an acceptable brightness dimming effect.

Figure 5:
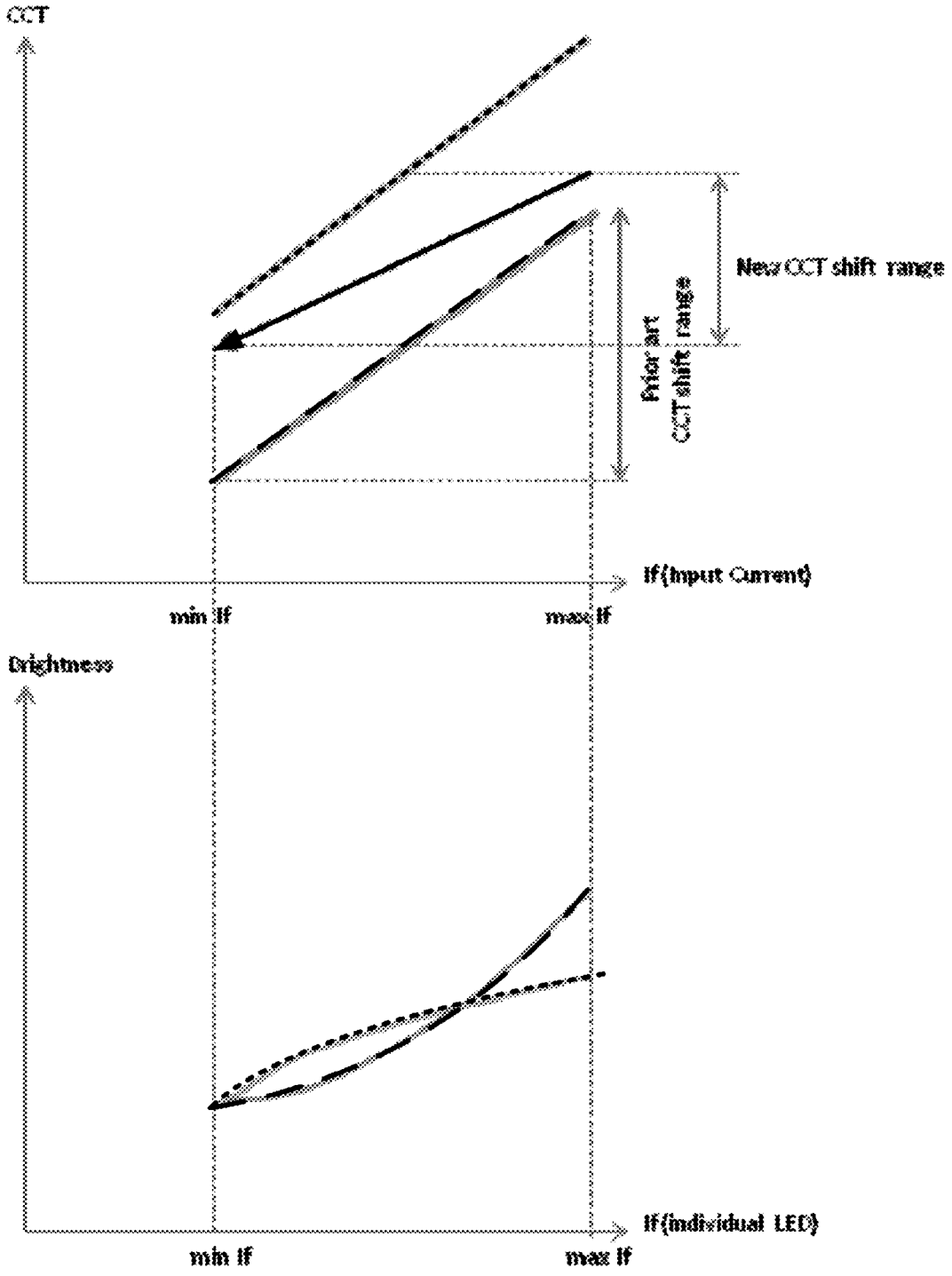
FIG. 5 is a set of charts depicting CCT and brightness as a function of input current for a third lighting arrangement in accordance with embodiments of the present disclosure.

With reference now to FIG. 5, yet another dimming strategy will be described in accordance with at least some embodiments of the present disclosure. The dimming strategy depicted in FIG. 5 shows a scenario where both the first and second sets of light sources 232*a*, 232*b* are lit (e.g., fully activated) at the same time and turned off (e.g., fully deactivated) at the same time. In this embodiment, the transition condition may still be an extended transition condition, but the extended transition condition may span the entire operating range of the sets of light sources 232*a*, 232*b*. This particular dimming strategy may have a slightly larger color shifting range as compared to the strategy depicted in FIG. 4, but the resultant CCT of the illumination device 100 or system 200 during dimming may be relatively smoother. Again, although the first and second sets of light sources 232*a*, 232*b* are depicted as being dimmed at substantially the same rate, embodiments of the present disclosure are not so limited. Rather, the first set of light sources 232*a* may be dimmed faster than a rate at which the second set of light sources 232*b* are dimmed, or vice versa.

Figure 6:
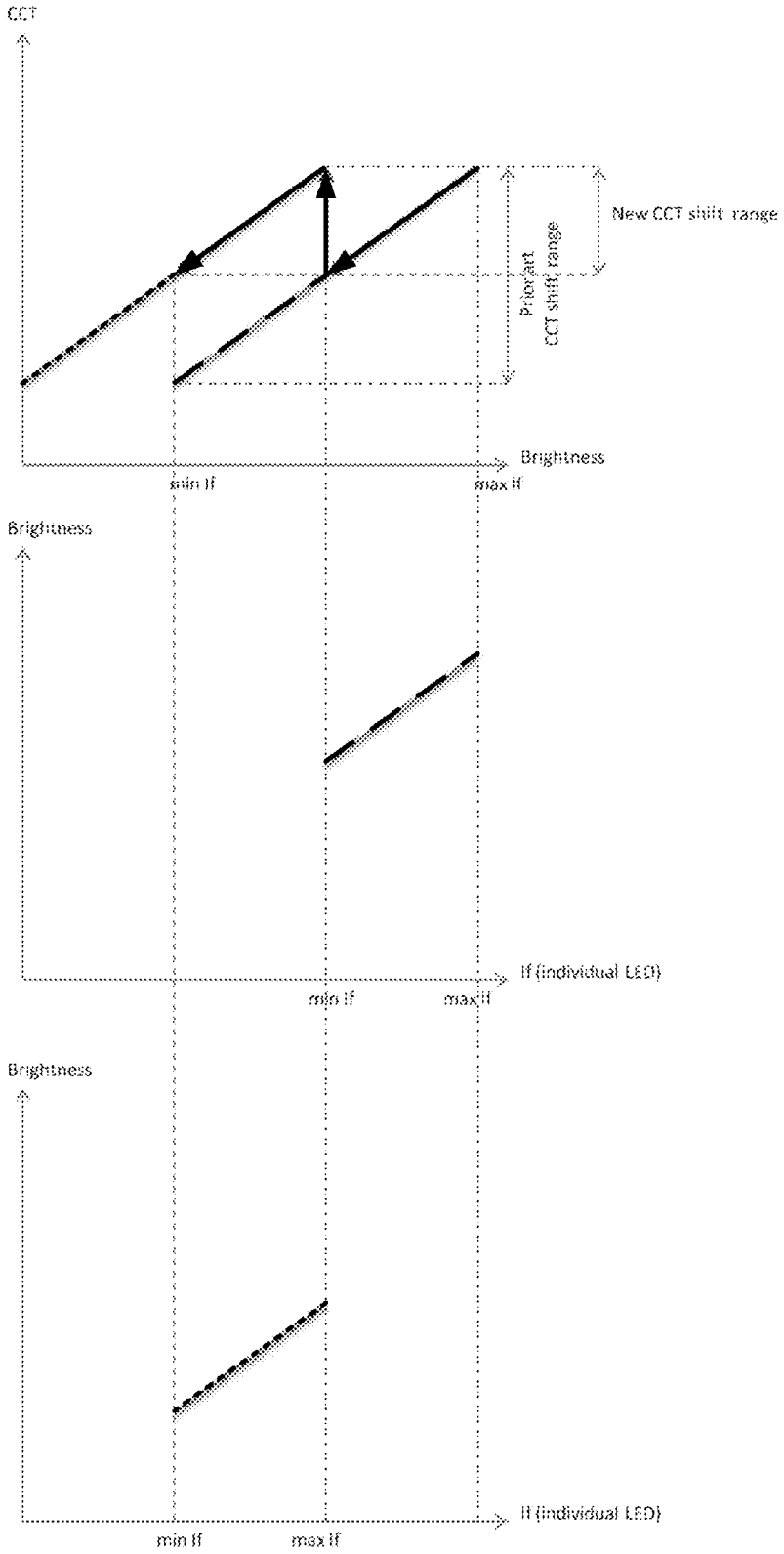
FIG. 6 is a set of charts depicting CCT and brightness as a function of input current for a fourth lighting arrangement in accordance with embodiments of the present disclosure.

FIG. 6 depicts still another dimming strategy in accordance with at least some embodiments of the present disclosure. This particular dimming strategy the second set of light sources 232*b* comprises a lower CCT as compared to the first set of light sources 232*a*. The desired brightness transition can minimized color shifting can still be achieved with such a configuration if the number of light sources in the second set of light sources 232*b* is fewer than the number of light sources in the first set of light sources 232*a*. When a transition condition is detected and the second set of light sources 232*b* are activated, they may be activated by providing a maximum current to the second circuit 220*b*. However, since the number of light sources in the second set of light sources 232*b* is less than the number of light sources in the first set of light sources 232*a*, the overall brightness emitted by the illumination device 100 or system 200 can be lowered to demonstrate the desired brightness continuity.

Figure 7:
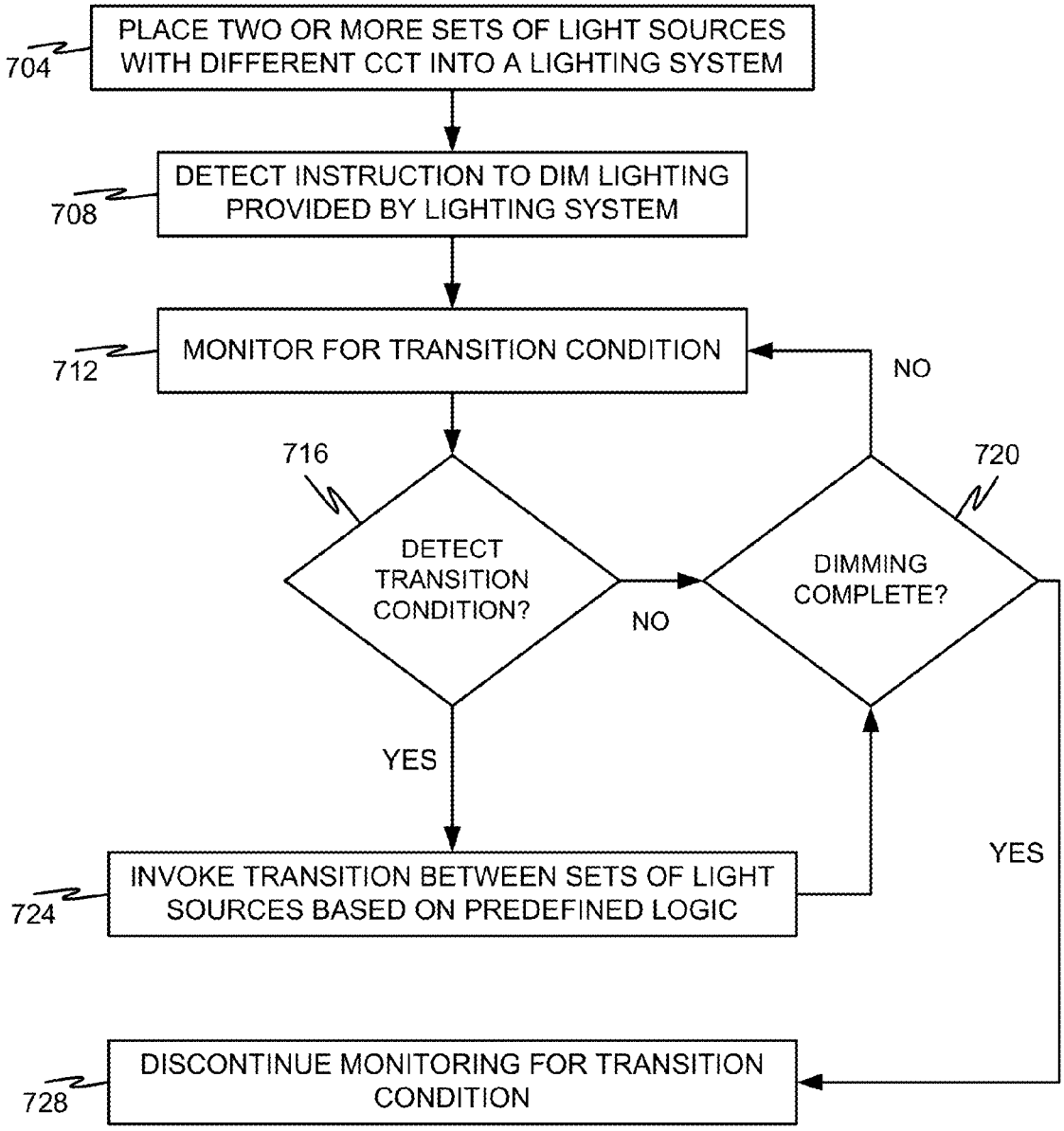
FIG. 7 is a flow chart depicting a dimming method in accordance with embodiments of the present disclosure.

FIG. 7 depicts an illustrative lighting control method in accordance with at least some embodiments of the present disclosure. The method depicted in FIG. 7 may correspond to or be used to implement any of the dimming strategies described above, alone or in combination.

The method begins by placing two or more sets of light sources, 232*a*, 232*b* for example, into a lighting system 200 (step 704). Thereafter, the instructions being received at receiver 208 from remote control 204 may be monitored until dimming instructions are received (step 708). It should be appreciated that dimming instructions may correspond to any input that indicates a desire to operate the illumination device 100 or system 200 at less than full brightness, with the overall brightness either decreasing or increasing.

The method continues with the control logic 216 monitoring the input for the occurrence of one or more transition conditions (step 712). The detected transition condition may correspond to a single transition condition, a boundary of an extended transition condition, or a setting within an extended transition condition. If no transition condition is detected (step 716), then the control logic 216 determines whether the dimming instructions are complete (step 720). If dimming instructions are still being received at the receiver 208, then the method returns to step 712. Otherwise, the control logic 216 discontinues monitoring for a transition condition (step 728).

Referring back to step 716, if a transition condition has been detected, the control logic 216 determines the dimming strategy to implement and instructs one or more of the drivers 228*a*, 228*b* to implement the dimming strategy (step 724). As noted above, the instructions provided to one or both drivers 228*a*, 228*b* may correspond to instructions to provide full current to the respective circuit, instructions to discontinue providing any current to the respective circuit, instructions to increase current provided to the respective circuit, and/or instructions to incrementally decrease current provided to the respective circuit. Thereafter, the method continues to step 720 to determine if dimming is complete.

Specific details were given in the description to provide a thorough understanding of the embodiments. However, it will be understood by one of ordinary skill in the art that the embodiments may be practiced without these specific details. For example, circuits may be shown in block diagrams in order not to obscure the embodiments in unnecessary detail. In other instances, well-known circuits, processes, algorithms, structures, and techniques may be shown without unnecessary detail in order to avoid obscuring the embodiments.

While illustrative embodiments of the disclosure have been described in detail herein, it is to be understood that the inventive concepts may be otherwise variously embodied and employed, and that the appended claims are intended to be construed to include such variations, except as limited by the prior art.

What is claimed is:

1. A dimmable illumination device, comprising:

a first set of light sources being driven by a first circuit driver;

a second set of light sources being driven by a second circuit driver; and a dimming control system including dimming control logic, the dimming control logic being configured to provide driving instructions to the first circuit driver and the second circuit driver, wherein the dimming control logic is programmed to monitor a dimming input signal for the illumination device and determine that the dimming input signal has reached a transition condition such that the first set of light sources is to be enhanced by the second set of light sources, wherein the transition condition is an extended transition condition comprising an upper bound and a lower bound, wherein the driving instructions cause both the first and second set of light sources to be fully activated at the same time and fully deactivated at the same time, and wherein the extended transition condition spans an entire operating range of both the first and second set of light sources.

2. The device of claim 1, further comprising:

a receiver configured to receive the dimming input signal from a remote control and provide the dimming input signal to the dimming control system.

3. The device of claim 2, wherein the receiver communicates with the remote control wirelessly.

4. The device of claim 1, wherein the upper bound corresponds to a point at which the dimming control logic instructs the first circuit driver to begin reducing current provided to the first set of light sources, the lower bound corresponding to a point at which the dimming control logic instructs the first circuit driver to stop providing current to the first set of light sources.

5. The device of claim 1, wherein the transition condition corresponds to a predetermined percentage of maximum brightness.

6. The device of claim 5, wherein the dimming control logic is programmed with hysteresis to prevent activating and deactivating the first set of light sources within a predetermined amount of time.

7. The device of claim 1, wherein at least one of the first and second sets of light sources is dimmable.

8. The device of claim 1, wherein the first set of light sources comprises a first Correlated Color Temperature (CCT), wherein the second set of light sources comprises a second CCT, and wherein the first CCT is lower than the second CCT.

9. The device of claim 1, wherein at least one of the first set of light sources and the second set of light sources comprises at least one of a Light Emitting Diode (LED), an array of LEDs, and an Organic LED (OLED) sheet.

10. The device of claim 1, wherein the first set of light sources comprises a different number of light sources as compared to the second set of light sources.

11. The device of claim 1, wherein the control logic comprises at least one of an Application Specific Integrated Circuit (ASIC), firmware, and a Programmable Logic Circuit (PLC).

12. The device of claim 1, wherein the dimming control logic causes the first set of light sources to be enhanced by the second set of light sources in response to determining that the dimming input signal has reached the transition condition.

13. The device of claim 1, wherein the dimming control logic causes the first set of light sources to be replaced by the second set of light sources in response to determining that the dimming input signal has reached the transition condition.

14. The device of claim 1, wherein the dimming control logic instructs the first circuit driver to decrease current provided to the first set of light sources in response to determining that the dimming input signal has reached the extended transition condition.

15. The device of claim 14, wherein the dimming control logic instructs the first circuit driver to decrease the current provided to the first set of light sources before instructing the second circuit driver to increase the current provided to the second set of light sources.

16. The device of claim 1, wherein the dimming control logic instructs the first circuit driver to cease providing current to the first set of light sources at substantially the same time that the dimming control logic circuit instructs the second circuit driver to cease providing current to the second set of light sources.

17. A dimmable illumination device, comprising:

a first light source;

a second light source; and a dimming control system including dimming control logic, the dimming control logic being configured to provide driving instructions to at least one circuit driver that drives the first and/or second light source, wherein the dimming control logic is programmed to monitor a dimming input signal for the illumination device and determine that the dimming input signal has reached a transition condition such that the first light source is to be enhanced by the second light source, wherein the transition condition is an extended transition condition comprising an upper bound and a lower bound, wherein the driving instructions cause both the first and second set of light sources to be fully activated at the same time and fully deactivated at the same time, and wherein the extended transition condition spans an entire operating range of both the first and second set of light sources.

18. The device of claim 17, wherein the upper bound corresponding to a point at which the dimming control logic instructs the at least one circuit driver to begin reducing current provided to the first light source.

19. The device of claim 17, wherein the first light source comprises a first Correlated Color Temperature (CCT), wherein the second light source comprises a second CCT, and wherein the first CCT is lower than the second CCT.

20. The device of claim 17, wherein the transition condition corresponds to a predetermined percentage of maximum brightness and wherein the dimming control logic is programmed with hysteresis to prevent activating and deactivating the first light source within a predetermined amount of time.

* * * * *